US009743752B2

(12) United States Patent
Sobków

(10) Patent No.: US 9,743,752 B2
(45) Date of Patent: Aug. 29, 2017

(54) SEWING MACHINE TABLE

(71) Applicant: KESSLER POLSKA SPOLKA Z O. O., Przeworno (PL)

(72) Inventor: Zbigniew Sobków, Ziebice (PL)

(73) Assignee: KESSLER POLSKA SP. Z O.O., Przeworno (PL)

( * ) Notice: Subject to any disclaimer, the term of this patent is extended or adjusted under 35 U.S.C. 154(b) by 0 days.

(21) Appl. No.: 14/903,768

(22) PCT Filed: Apr. 30, 2014

(86) PCT No.: PCT/PL2014/000045
§ 371 (c)(1),
(2) Date: Jan. 8, 2016

(87) PCT Pub. No.: WO2015/005809
PCT Pub. Date: Jan. 15, 2015

(65) Prior Publication Data
US 2016/0150875 A1 Jun. 2, 2016

(30) Foreign Application Priority Data
Jul. 12, 2013 (PL) ..... 404681

(51) Int. Cl.
*A47B 1/00* (2006.01)
*A47B 1/05* (2006.01)
*A47B 29/00* (2006.01)
*D05B 75/00* (2006.01)
*A47B 13/00* (2006.01)

(52) U.S. Cl.
CPC ..... *A47B 1/05* (2013.01); *A47B 13/003* (2013.01); *A47B 29/00* (2013.01); *D05B 75/00* (2013.01)

(58) Field of Classification Search
CPC ..... A47B 1/05; A47B 13/003; A47B 29/00; D05B 75/00
USPC ..... 312/208.5, 208.6; 108/65, 158.12
See application file for complete search history.

(56) References Cited

U.S. PATENT DOCUMENTS

| | | | | | |
|---|---|---|---|---|---|
| 110,711 | A * | 1/1871 | Wolfinger | A47B 85/08 | 312/208.5 |
| 341,881 | A * | 5/1886 | Cochran | D05B 75/06 | 312/208.5 |
| 2,133,127 | A * | 10/1938 | Waterman | D05B 75/06 | 108/63 |
| 2,565,456 | A * | 8/1951 | Peets | D05B 75/06 | 108/63 |
| 2,940,807 | A * | 6/1960 | Rubin | A47B 29/00 | 312/208.5 |

(Continued)

FOREIGN PATENT DOCUMENTS

| | | |
|---|---|---|
| FR | 2610015 | 7/1988 |
| GB | 803117 | 10/1958 |

*Primary Examiner* — Hanh V Tran
(74) *Attorney, Agent, or Firm* — Cherskov Flaynik & Gurda, LLC

(57) ABSTRACT

An extendable sewing machine table which uses a tabletop with a top surface, a bottom surface and four side surfaces is described. The tabletop is supported by a frame. The tabletop is attached to a bracket and the bracket is reversibly attached to the frame using adjustable bolts. An opening for a sewing machine is defined in the top surface of the tabletop. Also shown are tabletop extenders, which have a rail. Each extender's rail is received by a channel in the corresponding tabletop side surface.

6 Claims, 2 Drawing Sheets

(56) References Cited

U.S. PATENT DOCUMENTS

| | | | | | |
|---|---|---|---|---|---|
| 3,253,870 | A * | 5/1966 | Stanton | A47B 29/00 | 112/217.1 |
| 3,566,816 | A * | 3/1971 | Zilg | D05B 75/02 | 108/14 |
| 3,714,906 | A * | 2/1973 | Finestone | A47B 13/10 | 108/185 |
| 4,062,606 | A * | 12/1977 | Peets | D05B 75/02 | 312/208.5 |
| 5,628,257 | A * | 5/1997 | Conner | A47B 13/08 | 108/158.12 |
| 6,612,666 | B1 * | 9/2003 | Berning | A47B 29/00 | 312/194 |
| 6,942,418 | B2 | 9/2005 | Knauseder | | |
| 2007/0089648 | A1 * | 4/2007 | Harrison | A47B 9/16 | 108/115 |

* cited by examiner

SEWING MACHINE TABLE

PRIORITY

This application claims the benefits of priority as the nationalization of international application PCT/PL2014/000045, filed on Apr. 30, 2014, currently pending, which in turn claimed priority benefit of Polish Patent Application P.404681, filed on Jul. 12, 2013, currently pending.

BACKGROUND OF THE INVENTION

1. Field of the Invention

The field of the invention is work surfaces, such as industrial equipment table.

2. Background of the Invention.

In various embodiments, the invention provides an adjustable work surface, with one embodiment directed to a sewing machine table.

SUMMARY OF INVENTION

The object of the invention is a table for sewing machines, both for basic machines and for specialized machines.

A table for sewing machines shown in the description of utility model No. Ru 62774 is known. This table is composed of a frame to which a tabletop is mounted. The frame is composed of two stands releasably connected by two horizontal beams. The stand is composed of a base beam, the ends of which are based on pads. On the base beam, a pillar beam is mounted, and a tabletop bracket is mounted thereon. The base beams are connected to each other with one of the horizontal beams, and a foot treadle is mounted thereto. The tabletop bracket has at least three holes, and the pillar beam has, at its upper end, two elongated holes located along the beam, and in the said holes, coupling bolts are mounted, and the pad has a shielding flange with catches.

Also, a foldable structural element, especially a furniture structural member, shown in patent description EP 1508286, is known. This element comprises at least two planar sub-elements. The sub-elements have first surfaces and second surfaces and have at least one connecting edge and outside edges. The sub-elements being pivotably linked to each other along the connecting edges. At least one of the surfaces of one sub-element lying opposite the surface of the second sub-element. Fixing means which connect an outside edge of one of the sub-elements with another sub-element are provided. The outside edge of one of the sub-elements is connected with one of the surfaces of further sub-element. The outside edge of one of the sub-elements is connected with the outside edge of further sub-element. The fixing means is an adhesive. The adhesive is a synthetic adhesive, especially a hot melt type adhesive. The fixing means is in the form of an adhesive tape. The fixing means is in the form of a bracket.

The sewing machine table of the invention consists of a tabletop in the form of a plate with an aperture for the sewing machine, where the tabletop is placed on the frame. The table is characterized in that the tabletop has, in its side walls, notches, in which profile bars are pressed, preferably channel bars. The height of the profile bar is lower than or equal to half the thickness of the tabletop. The pressed profile bar is arranged symmetrically in relation to the thickness of the tabletop. The pressed profile bar is additionally fixed with screws to the tabletop. The tabletop has a thickness of at least 39 mm. The heads of the rails attached to the sides of the additional elements are seated in the pressed profile bars. The rails have their bases pressed in the notches in the side walls of the additional elements. The rails are pressed in the notches in the side walls of the additional elements at least to a depth of the thickness of the rail base. The profile bars are pressed in the side wall of the tabletop at least to a depth equal to the width of the channel bar. The pressed rail is additionally fixed with screws to the side of the additional element.

BRIEF DESCRIPTION OF DRAWING

The invention together with the above and other objects and advantages will be best understood from the following detailed description of the preferred embodiment of the invention shown in the accompanying drawings, wherein.

DETAILED DESCRIPTION OF THE INVENTION

Figure 1:
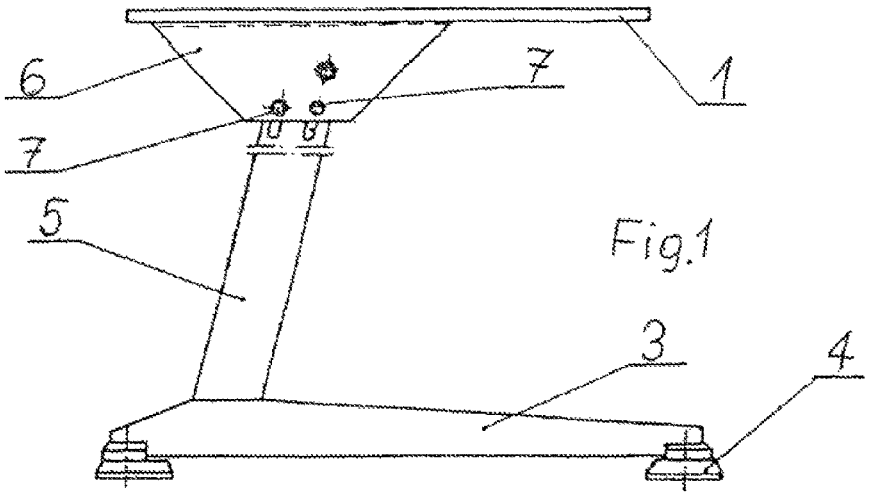
FIG. 1 depicts an overview of one embodiment of the invention.

The foregoing summary, as well as the following detailed description of certain embodiments of the present invention, will be better understood when read in conjunction with the appended drawings.

To the extent that the figures illustrate diagrams of the functional blocks of various embodiments, the functional blocks are not necessarily indicative of the division between hardware circuitry. Thus, for example, one or more of the functional blocks (e.g. processors or memories) may be implemented in a single piece of hardware (e.g. a general purpose signal processor or a block of random access memory, hard disk or the like). Similarly, the programs may be stand-alone programs, may be incorporated as subroutines in an operating system, may be functions in an installed software package, and the like. It should be understood that the various embodiments are not limited to the arrangements and instrumentality shown in the drawings.

As used herein, an element or step recited in the singular and proceeded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The sewing machine table of the invention, is characterized by simple construction and at the same time by unusual functionality as its construction allows shaping of any table surface, adapting it to current needs related to the use of the sewing machine. Surprisingly, it appeared that clamping connection in wooden or wood-based elements is significantly more durable than bolt connections. Therefore, this connection is a main connection which transmits forces occurring in this connection, and the used bolt elements constitute only an additional protection. In case of sewing small pieces, the existing table is sufficient and there is not any need to enlarge it. On the other hand, when changing the product range to sewing larger pieces, it would be necessary to replace the table with a larger one. Instead, in the present case, additional elements, which increase the size of the table, are added. At the same time, adding additional elements does not pose any difficulties because it is easy and quick, it occurs by inserting the rail with an additional element into the channel bar, pressed to the side of the table. Further, when sewing small pieces, it is necessary to refer to the design of the product sewn. With this table construction, its extension is possible by adjusting its surface to the size of the design.

Figure 2:
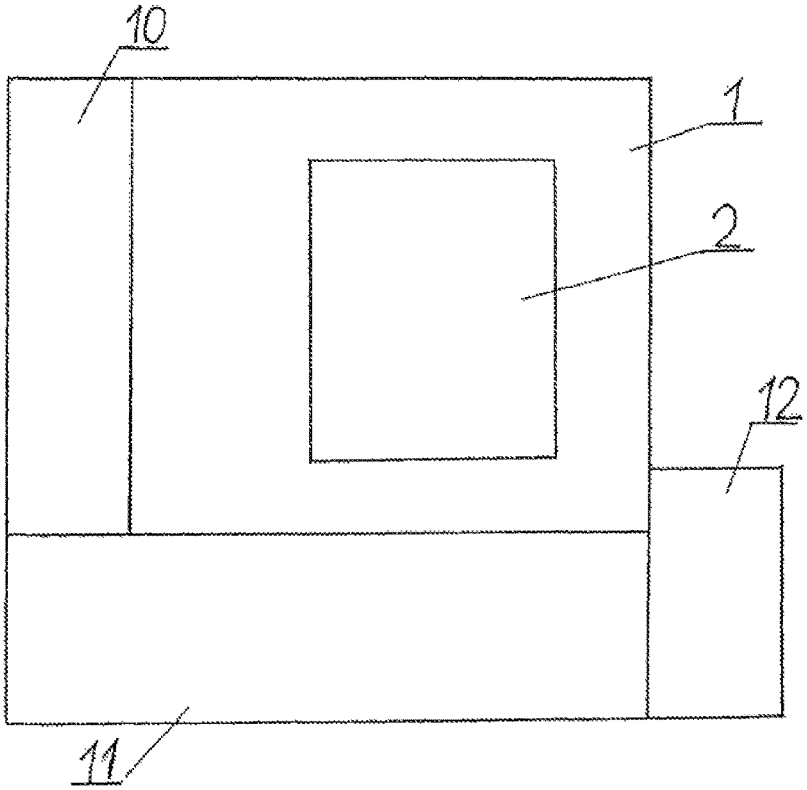
FIG. 2 depicts the details of the work surface of one embodiment of the invention.
Figure 3:
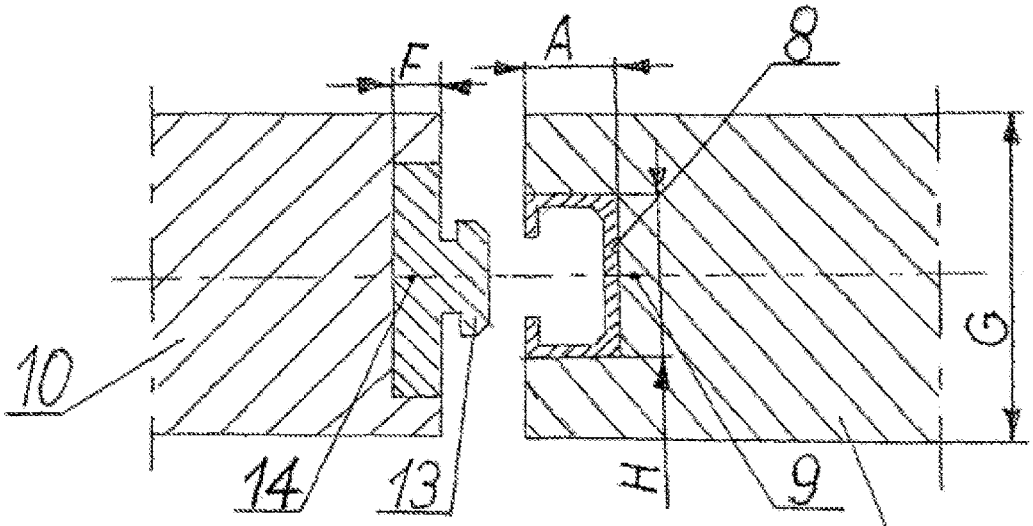
FIG. 3 depicts a profile view of the bar and rail extension of one embodiment of the invention.

The sewing machine table of the invention, is explained in details in the embodiment and in the drawing, in which FIG. 1 shows the table in a side view with the tabletop without additional elements, FIG. 2 is a top view of the tabletop with additional elements, FIG. 3 is a cross section through the connection of the tabletop with an additional element, the additional element being spaced from the tabletop.

As shown in FIG. 1-FIG. 3, the sewing machine table of the invention consists of a tabletop 1 in the form of a plate with an aperture 2 for the sewing machine. The tabletop 1 is placed on a frame.

The frame is composed of two stands connected by horizontal beams. Each stand is composed of a base beam 3, the ends of which are based on pads 4. On the base beam 3, a pillar beam 5 is mounted, and on the latter, a bracket 6 of the tabletop 1 is mounted. The bracket 6 is connected to the pillar beam 5 by means of regulatory bolts 7, whereby it is possible to adjust the level and inclination of the tabletop 1.

The tabletop 1 has, in the side walls, notches in which profile bars, in the form of channel bars 8, are pressed. Height H of the channel bar 8 is equal to half the thickness G of the tabletop 1. The pressed channel bar 8 is arranged symmetrically in relation to the thickness G of the tabletop 1. The pressed channel bar 8 is additionally fixed with screws 9 to the tabletop 1. This connection is made in a known manner, thereby the screws 9 are only indicated axially. The tabletop 1 has a thickness of 40 mm. In order to extend the tabletop 1 of the sewing machine table, additional elements 10, 11 and 12 are made. In the sides of the additional elements 10, 11 and 12, notches are formed, the size of these notches being varied according to the position of this element and its connection.

The additional element 10 has its longer side in contact with the tabletop 1, and in this side, a notch for a rail 13 base is formed. On the other hand, the connection of the shorter side of the additional element 10 with the side of the additional element 11 is also the connection shown in FIG. 3, however, a notch for the channel bar 8 is formed in the shorter side of the additional element 10. The connection of the additional elements 11 and 12 is made likewise, where in the shorter side of the additional element 12, a notch for the channel bar 8 is formed. The rails 13 are pressed into the sides of the additional elements 10, 11 and 12 to a depth F equal to the thickness of the rail 13 base. The channel bars 8 are pressed in the side wall of the tabletop 1 to a depth equal to the width A of the channel bar 8. The pressed rail 13 is additionally mounted with screws 14 to the side of the additional element 10 or 11, or 13, in a known manner, thereby the screws are only indicated axially.

A sewing machine table consisting of a tabletop in the form of a plate with an aperture for the sewing machine, where the tabletop is placed on a frame, characterized in that the tabletop (1) has, in its side walls, notches into which profile bars, preferably channel bars (8), are pressed.

The table is also characterized in that the height (H) of the profile bar (8) is lower than or equal to half the thickness (G) of the tabletop (1).

The table is also characterized in that the pressed profile bar (8) is arranged symmetrically in relation to the thickness (G) of the tabletop (1).

The table is also characterized in that the pressed profile bar (8) is additionally fixed with screws (9) to the tabletop (1).

The table is also characterized in that the tabletop (1) has a thickness (G) of at least 39 mm.

The table is also characterized in that the heads of the rails (13) attached to the sides of the additional elements (10, 11, 12) are seated in the pressed profile bars (8).

The table is also characterized in that the rails (13) have their bases pressed in the notches in the side walls of the additional elements (10, 11, 12).

The table is also characterized in that the rails (13) are pressed in the notches in the side walls of the additional elements (10, 11, 12) at least to a depth (F) equal to the thickness of the rail (13) base.

The table is also characterized in that the profile bars (8) are pressed in the side wall of the tabletop (1) at least to a depth equal to the width (A) of the channel bar (8), The table is also characterized in that the pressed rail (13) is additionally mounted with screws (14) to the side of the additional element (10, 11, 12).

The object of the invention is a table for sewing machines, both for basic machines and for specialized machines. The sewing machine table consists of a tabletop in the form of a plate with an aperture for the sewing machine, where the tabletop is placed on a frame, characterized in that the tabletop (1) has, in its side walls, notches into which profile bars, preferably channel bars (8), are pressed. The height (H) of the profile bar (8) is lower than or equal to half the thickness (G) of the tabletop (1).

The pressed profile bar (8) is arranged symmetrically in relation to the thickness (G) of the tabletop (1). The pressed profile bar (8) is additionally fixed with screws (9) to the tabletop (1). The tabletop (1) has a thickness (G) of at least 39 mm. The heads of the rails (13) attached to the sides of the additional elements (10, 11, 12) are seated in the pressed profile bars (8).

Although exemplary implementations of the invention have been depicted and described in detail herein, it will be apparent to those skilled in the relevant art that various modifications, additions, substitutions, and the like can be made without departing from the spirit of the invention and these are therefore considered to be within the scope of the invention as defined in the following claims.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

The embodiment of the invention in which an exclusive property or privilege is claimed is defined as follows:

1. An extendable sewing machine table consisting of:

a tabletop having a top surface, a bottom surface and four side surfaces; wherein said tabletop is supported by a frame wherein said tabletop is attached to a bracket and said bracket is reversibly attached to the frame using adjustable bolts and wherein an aperture for receiving a sewing machine is defined in the top surface of said tabletop; and one or more tabletop extenders wherein one side of each of the extenders comprises a rail mounted in a notch within the extender by screws; wherein said rail comprises a base, an extending member, and a rail head wherein said rail is reversibly received by a channel bar secured in an indentation defined in at least one side surface of said tabletop by screws; wherein the rail head abuts the channel bar after sliding the rail head into the channel bar;

wherein the height of the indentation in at least one tabletop side surface is less than the thickness of the tabletop.

2. The table of claim 1 wherein the indentation is symmetric and in a middle of said at least one tabletop side surface.

3. The table of claim 1 wherein the thickness of the tabletop is at least 39 mm.

4. The table of claim 1 wherein the depth of each notch is at least as large as the height of the corresponding rail base.

5. The table of claim 1 wherein said indentation depth is at least as large as a width of the channel bar.

6. An extendable sewing machine table consisting of:

a tabletop having a top surface, a bottom surface and four side surfaces; wherein said tabletop is supported by a frame wherein said tabletop is attached to a bracket and said bracket is reversibly attached to the frame using adjustable bolts and wherein an aperture for receiving a sewing machine is defined in the top surface of said tabletop; and one or more tabletop extenders wherein one side of each of the extenders comprises a rail; wherein said rail comprises a base, an extending member, and a rail head wherein said rail is reversibly received by a channel bar secured in an indentation defined in at least one side surface of said tabletop; wherein the rail head abuts the channel bar after sliding the rail head into the channel bar;

wherein the height of the indentation in at least one tabletop side surface is less than the thickness of the tabletop.

* * * * *